US005822394A

United States Patent [19]

Schardt et al.

[11] Patent Number: 5,822,394

[45] Date of Patent: Oct. 13, 1998

[54] X-RAY TUBE WITH RING-SHAPED ANODE

[75] Inventors: Peter Schardt, Roettenbach; Erich Hell, Erlangen, both of Germany

[73] Assignee: Siemens Aktiengesellschaft, Munich, Germany

[21] Appl. No.: 824,723

[22] Filed: Mar. 26, 1997

[30] Foreign Application Priority Data

Apr. 10, 1996 [DE] Germany ..... 196 14 222.9

[51] Int. Cl.[6] ..... H01J 35/10

[52] U.S. Cl. ..... 378/125; 378/144

[58] Field of Search ..... 378/125, 136, 378/137, 143, 144

[56] References Cited

U.S. PATENT DOCUMENTS 2,791,708 5/1957 Serduke .
4,788,705 11/1988 Anderson ..... 378/121
5,703,926 12/1997 Bischof ..... 378/125

FOREIGN PATENT DOCUMENTS 0 187 020 12/1984 European Pat. Off. .
0 473 852 3/1992 European Pat. Off. .
881974 7/1953 Germany .
8713042 U 5/1987 Germany .

*Primary Examiner*—Don Wong
*Attorney, Agent, or Firm*—Hill & Simpson

[57] ABSTRACT

An X-ray tube having a vacuum housing rotatable around a rotational axis, a ring-shaped anode connected to the vacuum housing whose center axis corresponds to the rotational axis, a cathode arranged inside the vacuum housing and that surrounds the rotational axis and that emits electrons radially outward during operation of the X-ray tube, a rotatable support for the vacuum housing, a drive arrangement for turning the vacuum housing and an arrangement for focussing the electron beam proceeding from the cathode to the anode which focus the electron beam such that it strikes the anode in a stationary focal spot.

12 Claims, 5 Drawing Sheets

X-RAY TUBE WITH RING-SHAPED ANODE

BACKGROUND OF THE INVENTION

1. Field of the Invention

The present invention is directed to an X-ray tube of the type having a vacuum housing rotatable around a rotational axis, a cathode and anode connected to the vacuum housing, means for rotatably supporting the vacuum housing and means for focussing the electron beam proceeding from the cathode to the anode.

2. Description of the Prior Art

For increasing the average electrical power, anodes in X-ray tubes are usually executed as rotating anodes that are accepted in the vacuum housing of the X-ray tube and are essentially radiantly cooled. As a result of the rotational motion of the rotating anode in the vacuum housing of the X-ray tube, the heat quantity emitted by the electron beam that proceeds from the cathode to the anode, and is incident in a stationary focal spot, is distributed onto an annular focal spot path. An inherently desirable, direct cooling of the anode by a coolant that allows a significant increase in the average electrical power has been hitherto reserved for fixed anodes and can be achieved at best in rotating anodes given great difficulty.

For example, U.S. Pat. No. 2,791,708 discloses such a fixed anode X-ray tube wherein a cathode that radially outwardly emits electrons surrounds an annular anode arranged on a cooling member provided with cooling channels. During operation of the X-ray tube, the radially outwardly emitted electrons generate an annular focal spot on the annular anode, and as a result the anode is heated less locally compared to a punctiform focal spot. A coolant additionally circulates through the cooling channels of the cooling member and cools the anode.

Given rotating anode X-ray tubes, a cooling by thermal conduction must ensue via the bearing system provided for the rotational bearing of the rotating anode, and leads to only a slight amount of transported heat even given employment of an involved liquid metal plain bearing. The ball bearings running in the vacuum given current rotating anode X-ray tubes are also problematical since, first, only solid lubrication is possible in the vacuum and, second, the bearings must be operated with large bearing play because of the temperature fluctuations occurring during operation of the X-ray tube. They therefore frequently tend to vibrate, this being expressed in loud running noises, and, due to relatively high wear, limit the service life of current rotating anode X-ray tubes, this having a negative economic effect.

Previous solutions for increasing the average electrical power of rotating anode X-ray tubes usually aim at also making rotating anodes compatible for higher and medium powers by increasing the heat capacity and the radiation power. As a result, however, increasingly longer pauses for cooling these X-ray tubes are required between successive X-ray exposures. The limit of the average electrical power that can thereby be achieved lies at about 10 kW. Since, however, the X-ray tubes become heavier and bulkier with increasing average electrical power, they can only be manipulated with difficulty.

Solutions for avoiding the bearing problems and for eliminating the running noises provide for the employment of liquid metal plain bearings and, over the long-term, the employment of magnetic bearings. Although liquid metal plain bearings and magnetic bearings promise a reduction of the running noises and of the bearing wear, they are nonetheless not able to transport greater quantities of heat, and thus cannot assist in making the cooling of the rotating anode of the X-ray tube more effective.

Other solutions aim at fashioning the X-ray tube as what is referred to as a rotating tube and having it rotate in a preferably electrically insulating coolant. For example, German Utility Model 87 13 042 discloses such an X-ray tube. This X-ray tube, whose cathode and anode are rigidly connected to the vacuum housing of the X-ray tube, is surrounded by a protective housing filled with insulating oil and is seated therein rotatable around its center axis. The insulating oil, which serves as coolant at the same time, circulates through the protective housing and thus allows an elimination of the dissipated heat occurring during operation of the X-radiator. In order to assure that the electron beam emanating from the cathode arranged on the center axis of the X-ray tube is incident in a stationary focal spot on the rotating anode, a stationary deflection system for the electron beam is arranged outside the vacuum housing of the X-ray tube.

Such a rotating tube is also disclosed in European Application 0 473 852, wherein the rotating tube does not rotate in a coolant.

Further, German Patent 881 974 discloses a rotating tube rotating in a coolant oil with a magnetically fixed electron ray beam, wherein the anode is fashioned as a hollow anode that projects from the glass member of the vacuum housing and does not surround the cathode.

What proves problematical in such solutions is the bulky structure of the X-ray tubes that produces bearing problems in conjunction with high speeds that in turn produce stability problems of the focal spot and that, especially in computer tomography, are expressed as a disturbing wobble of the focal spot.

SUMMARY OF THE INVENTION

An object of the present invention is to provide a rotating anode X-ray tube of the type initially described wherein a direct cooling of the anode is possible and wherein conditions for the stability of the focal spot are also nonetheless established at high speeds.

This object is inventively achieved by an X-ray tube having a vacuum housing rotatable around a rotational axis, an annular, preferably hollow-cylindrical anode connected to the vacuum housing whose center axis corresponds to the rotational axis, a cathode surrounding the rotational axis and arranged within the vacuum housing that emits electrons radially outward during operation of the X-ray tube, means for rotatably supporting the vacuum housing, drive means for turning the vacuum housing and means for focussing the electron beam proceeding from the cathode to the anode that focus the electron beam such that it is incident onto the anode in a stationary focal spot. A short structure of the vacuum housing is possible as a result of the annular design of the anode surrounding the cathode. The short structure of the vacuum housing, however, allows a stiff bearing of the vacuum housing, and as a result whereof high speeds of the vacuum housing are possible during operation of the X-ray tube while guaranteeing the stability of the focal spot. The anode and the preferably rotational-symmetrical cathode are at rest relative to one another. According to one version of the invention, the means for focussing the electron beam can thereby comprise magnetic and electrostatic means.

European Application 0 187 020 discloses an X-ray tube of the type initially described, but the cathode thereof neither surrounds the rotational axis of the X-ray tube nor emits electrons radially outwardly on all sides during operation of the X-ray tube. On the contrary, the cathode is held stationary with a bearing an magnets during operation of the X-ray tube.

According to a preferred embodiment of the invention, the magnetic means for focussing the electron beam proceeding from the cathode to the anode are composed of at least two electromagnets or permanent magnets that surround the vacuum housing of the X-ray tube in sections or press thereagainst and are at rest relative to the vacuum housing. The electrostatic means for focussing the electron beam contain a preferably rotational-symmetrical Wehnelt electrode arranged inside the vacuum housing that includes two electrode sections arranged at opposite sides of the cathode and whose center axis is the rotational axis. An electrostatic field distribution that, without further measures, would accelerate electrons emitted from the heated cathode radially outwardly, so to speak star-like in the direction onto the anode is thus present between the cathode and the anode inside the vacuum housing of the X-ray tube. The magnetic means for focussing are provided in order to form an electron beam incident on the anode in a stationary focal spot. In the magnetic field generated by the magnetic means, a deflecting force acts on the electrons moving radially toward the anode, this force deflecting the electrons—except for those that emanate from the region lying radially opposite the focal spot—out of their initially radially directed paths such that a radially directed electron beam is formed. The deflection of the electrons in the magnetic field decreases as the kinetic energy of the electrons increases, i.e. the electrons are deflected the most close to their exit point at the cathode since the influence of the electrostatic field between cathode and anode that radially accelerates them is still low at that location. The magnetic field that is generated by the stationary magnetic means for focussing, and that is likewise stationary, thereby holds the electron beam formed of electrons emitted from the cathode and deflected in the magnetic field stationary during operation of the X-ray tube when the latter rotates, so that the focal spot describes an annular focal spot path on the anode. The focussing force on the electrons in the plane perpendicular to the rotational axis arising due to the magnetic field simultaneously defines the width of the focal spot imaged on the incident surface of the anode.

The defocussing force acting on the electron beam in the direction of the rotational axis is electrostatically opposed by the Wehnelt electrode. A force focussing in the direction of the rotational axis thereby acts on the electrons forming the electron beam, this force influencing the length of the focal spot of the electron beam on the incident surface on the anode.

The shape of the focal spot on the incident surface on the anode is thus defined by the shape and the strength of the magnetic field as well as by the strength of the electrostatic focussing of the electron beam. A variable focal spot can thus be realized simply by a suitable combination of the coil currents of the electromagnets and the voltage at the Wehnelt electrode.

An embodiment of the invention includes a preferably rotational-symmetrical control electrode within the vacuum housing that is stationary with reference to the vacuum housing and whose center axis is the rotational axis. The control electrode is executed in the form of a grid and additionally enables a pulsed operation of the X-ray tube when a control signal having a corresponding signal curve is applied to the grid.

In a further version of the invention the vacuum housing of the X-ray tube is rotatably seated with rolling bearings, particularly ball bearings. Since no bearing parts are located in the vacuum housing of the X-ray tube, the balls bearings can be lubricated wet, the wear and the running noises being capable of being greatly reduced as a result. An easy accessibility of the ball bearings also allows them to be replaced, thereby enhancing the economic feasibility of such an X-ray tube. Moreover, the ball bearings can be implemented free of play, with the stability of the focal spot being improved as a result.

An electric motor or a pneumatic drive can be provided as drive means for turning the vacuum housing in a version of the invention. The drive can thereby attack directly at the anode or at a shaft rigidly connected to the vacuum housing of the X-ray tube.

Preferably the anode is directly charged with a coolant, preferably a liquid like insulating oil. The active cooling of the anode enables high continuous power during operation of the X-ray tube and a noticeable reduction of the cooling times of the X-ray tube given successive X-ray exposures.

In a version of the invention the coolant charges the outside of the anode as a directed flow. The outside of the anode is thereby provided with paddles that are influenced by the flow of the coolant so that a torque, turning the vacuum housing around the rotational axis, occurs. Specific drive means for the rotation of the vacuum housing can then be eliminated since drive is achieved by the paddles and by the flow incident thereon.

DESCRIPTION OF THE PREFERRED EMBODIMENTS

Figure 1:
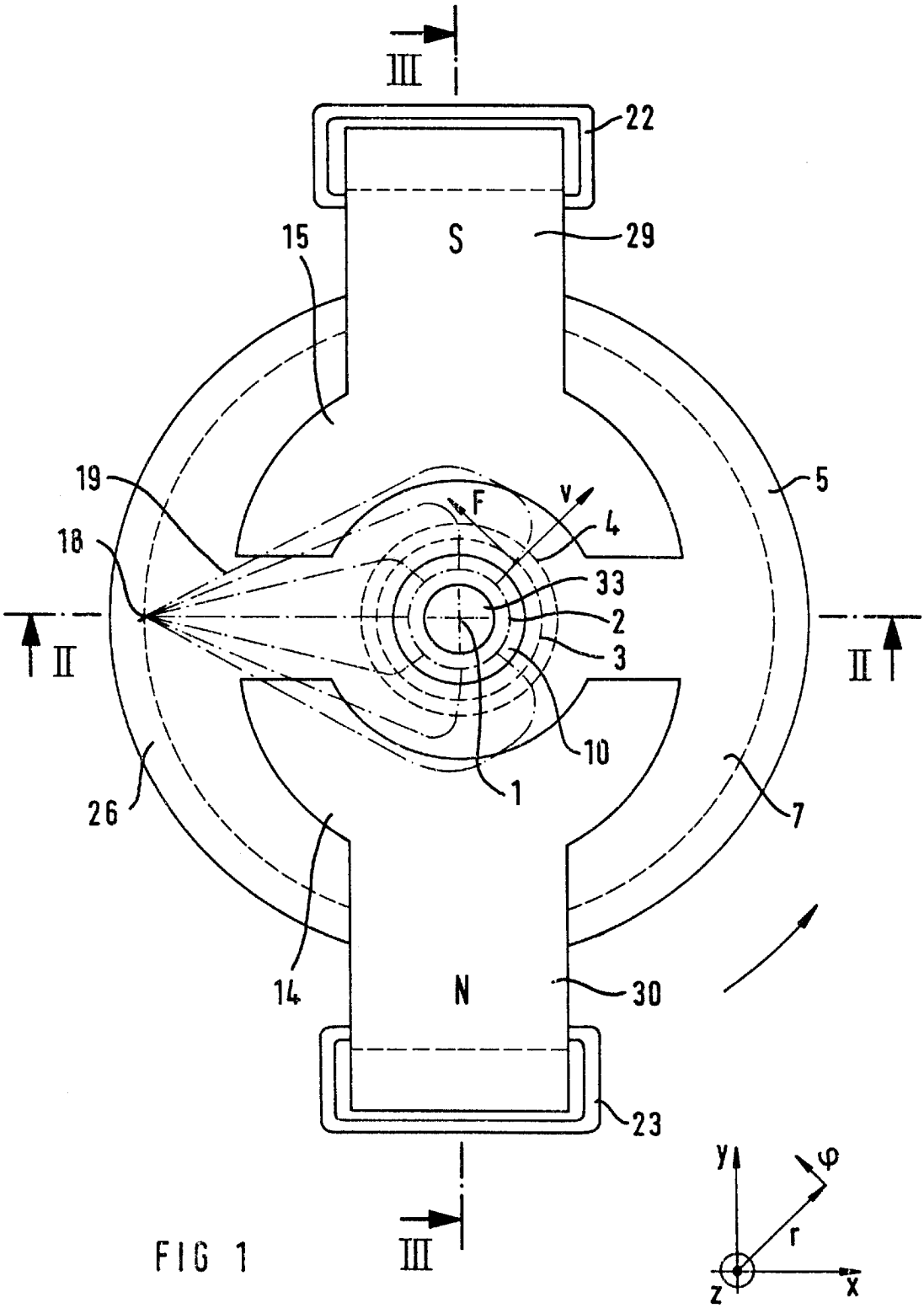
FIG. 1 is a plan view onto an inventive rotating X-ray tube with the cathode and path course of the electrons indicated with dot-dashed lines.

The inventive X-ray tube shown in FIG. 1 has a flat, cylindrical vacuum housing 26 that is rotatably seated via a shaft 33 that is rigidly connected to the vacuum housing 26. The shaft 33 extends through the vacuum housing 26 and has a center axis corresponding to a rotational axis 1 that is the center axis of the vacuum housing 26. The vacuum housing 26 of the X-ray tube is composed of an annular anode 5 whose cylindrical outside surface forms the surfaces of the cylindrical vacuum housing 26, a circular cover 7 and a circular floor 8. The cover 7 and the base 8 of the vacuum housing 26 of the X-ray tube are composed of an insulating material, for example ceramic or glass that is preferably provided with a high-impedance conductive layer. By contrast to the cylindrical outside surface of the anode 5, the inside surface of the anode 5 lying in the vacuum of the X-ray tube is composed of two cylindrical surface sections 27 and 28 of different diameters, and a conical surface section 6 connected to the former. The conical surface section 6 forms the incident surface for an electron beam 19 proceeding from a cathode 2 to the annular anode 5.

Electrically insulated within the vacuum housing 26 of the X-ray tube, the tubularly fashioned, rotational-symmetrical cathode 2 surrounds the shaft 33 and lies directly against the cover 7 and the base 8 of the vacuum housing 26 of the X-ray tube. A rotationally symmetrically fashioned Wehnelt electrode 3 is put in place onto the cathode 2 as electrostatic focussing means. The Wehnelt electrode 3 is formed by two electrode sections 3*a* and 3*b* that lie opposite one another and are arranged at the ends of the cathode 2 in the region of the cover 7 and of the base 8 of the vacuum housing 26 of the X-ray tube, and between which the middle region of the cathode 2 is located. The cathode 2 and the Wehnelt electrode 3 are electrically insulated from one another. A control electrode 4 is rigidly connected to the vacuum housing 26 of the X-ray tube and is likewise rotational-symmetrically fashioned and is arranged such that its center axis corresponds to the rotational axis 1. The tube-like control electrode 4 is constructed in the form of a grid and is secured to the base 8 and/or cover 7 in a way not shown in detail.

Figure 2:
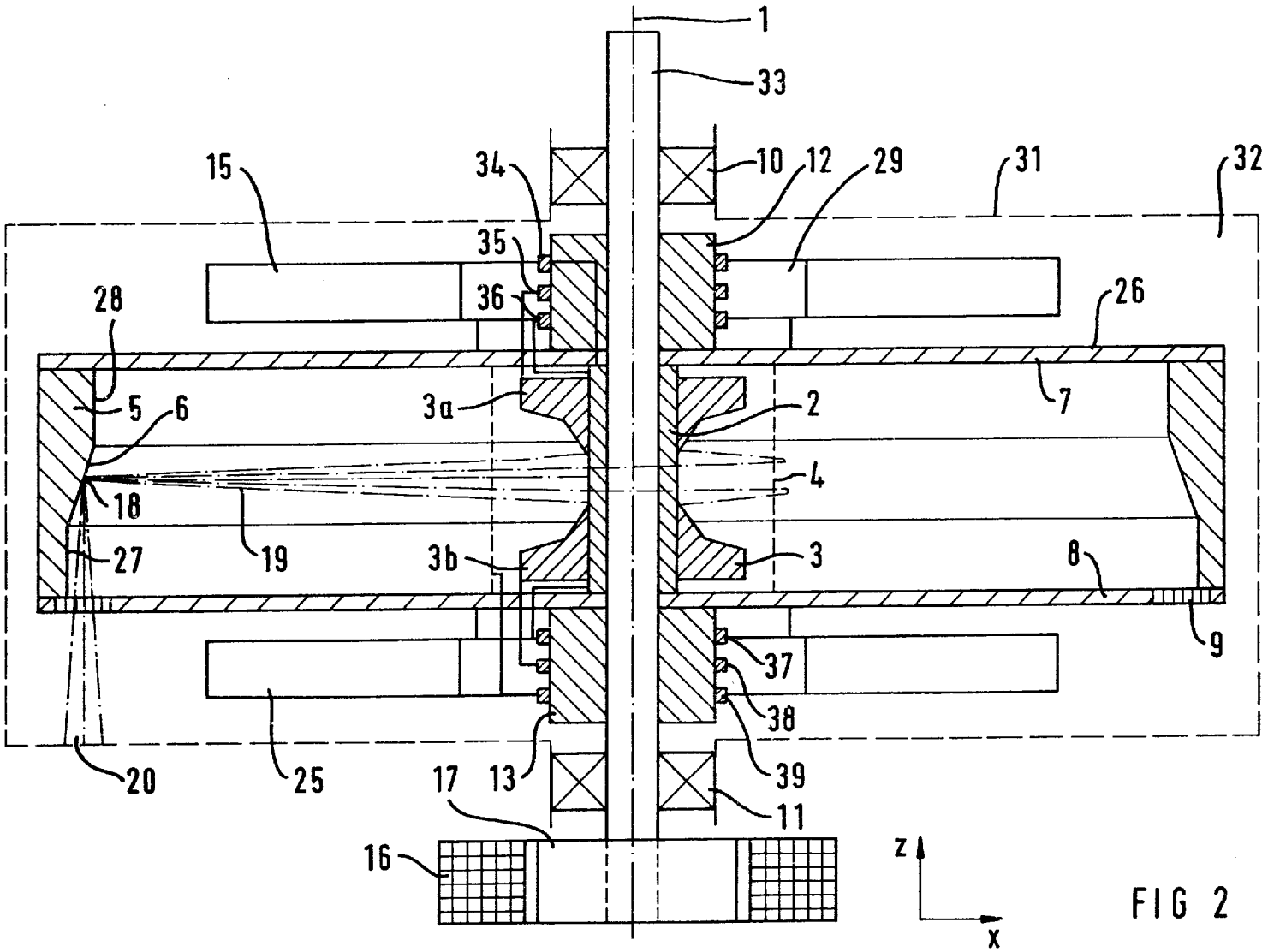
FIG. 2 is a section along the line II—II in FIG. 1 with the path course of the electrons indicated with dot-dashed lines.
Figure 3:
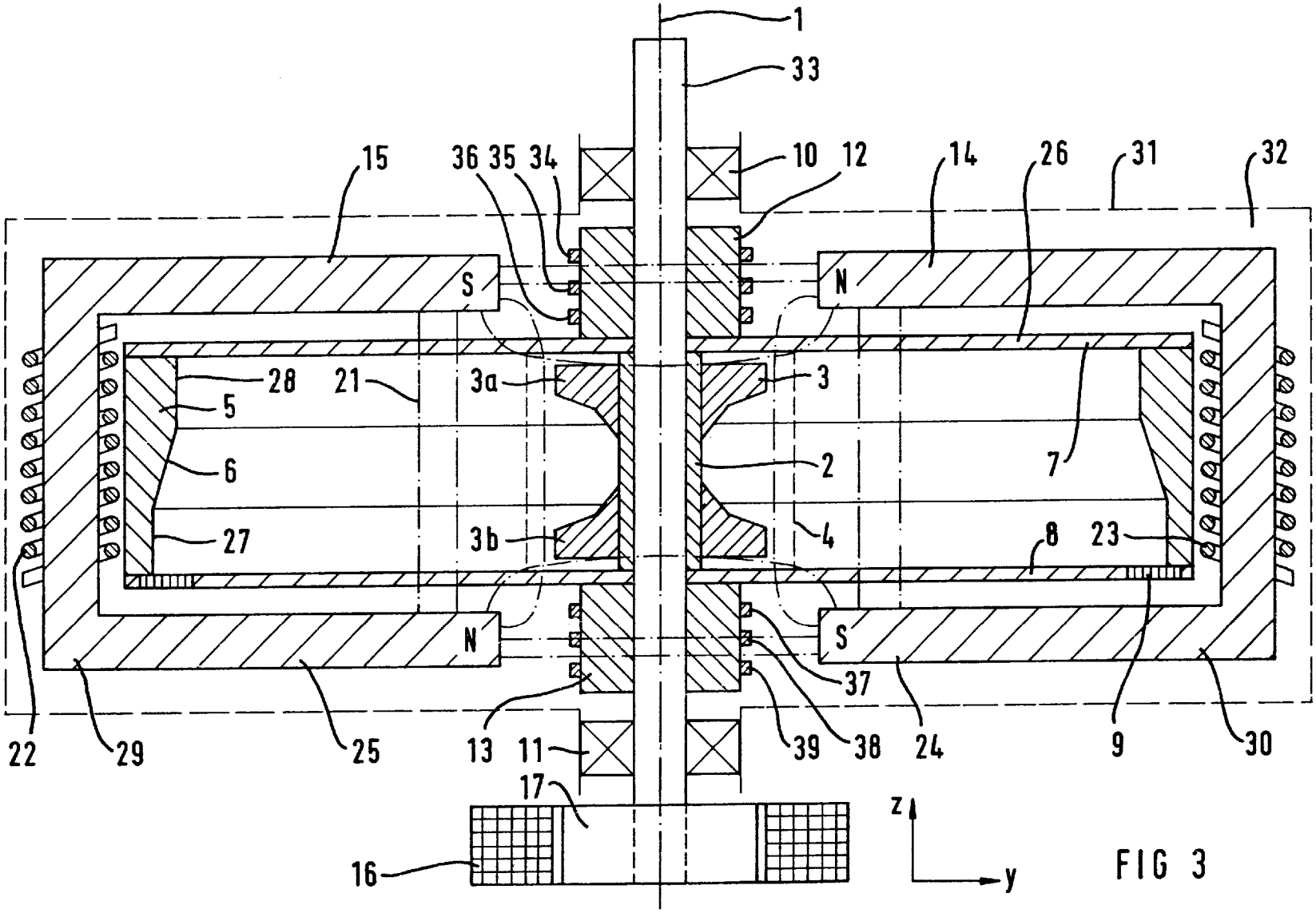
FIG. 3 is a section along the line III—III in FIG. 1 with the path course of the magnetic field lines indicated with dot-dashed lines.

Dependent on the material of which the base 8 of the vacuum housing 26 is fabricated, this, as shown in FIGS. 2 and 3, can have an annular beam exit window 9 in order to enable the unimpeded emergence of the useful X-ray beam 20 from the vacuum housing 26.

The cathode 2 is formed by a tubular body composed of a suitable material, for example lanthanum hexaboride ($LaB_6$), that is heated by direct current passage to the temperature required for the electron emission. The cathode 2 lies at negative high-voltage, relative to the anode 5 at ground potential. Moreover, there is also the possibility of indirectly heating the cathode 2, for example with an annular heating coil arranged inside the cathode 2. The negative high-voltage and the filament voltage for the cathode 2 as well as the voltages for the Wehnelt electrode 3 and the control electrode 4 are respectively applied to wiper rings 34 through 39 that are attached to the high-voltage insulators 12 and 13 and surround them. The tube-like high-voltage insulators 12 and 13 embrace the shaft 33 and lie against the cover 7 and the base 8 of the vacuum housing 26 from the outside. The cathode 2, the Wehnelt electrode 3 as well as the control electrode 4 are respectively connected to the corresponding wiper rings via leads that are insulated from one another. The connection of the annular anode 5 to grounded potential likewise ensues via a wiper ring that is not shown in FIGS. 1 through 3. The generators that generate the voltages for the cathode 2, the Wehnelt electrode 3 and the control electrode 4 as well as the wiper contacts gliding on the wiper rings 34 through 39 are also not shown in FIGS. 1 through 3.

Further, magnetic means that are at rest relative to the vacuum housing 26 of the X-ray tube are provided for the magnetic focussing of the electron beam 19 proceeding from the cathode 2 to the anode 5, these means being formed by two electromagnets 29 and 30 with U-shaped magnet cores that are provided with rectangular excitation coils 22 and 23 and semicircular pole shoes 15, 25 and 14, 24 that have semi-circular cut-outs. As may be seen from FIG. 1, the electromagnets 29 and 30 surround the cylindrical vacuum housing 26 of the X-ray tube such that their pole shoes are directed toward one another in the y-direction (see the coordinate system entered in FIG. 1), so that, as can be derived from FIGS. 1 and 3, the pole shoes 14 and 15 and the pole shoes 24 and 25 have their semicircular cut-outs that surround sections of the shaft 33 proceeding in the z-direction and sections of the high-voltage insulators 12, 13 in non-contacting fashion, lying opposite one another.

The course of the magnetic field lines 21 between the poles of the electromagnets 29 and 30 is entered with broken lines in FIG. 3. In the exemplary embodiment, the excitation coils 22 and 23 of the electromagnets 29 and 30 are respectively charged with the excitation current so that the pole shoe 15 represents the south pole and the pole shoe 25 represents the north pole of the electromagnet 29 and the pole shoe 14 represents the north pole and the pole shoe 24 represents the south pole of the electromagnet 30.

The magnet cores of the electromagnets 29 and 30 need not necessarily have a U-shape and the excitation coils need not necessarily have a rectangular shape but, for example, can be fashioned semicircular or round.

During operation of the X-ray tube, the vacuum housing 26 of the X-ray tube rotates around the rotational axis 1. The heated cathode 2 emits electrons that are initially accelerated radially from the cathode 2 toward the anode 5 due to the electrostatic field distribution between the cathode 2 and the anode 5. For forming a stationary focal spot 18 on the incident surface 6 of the anode 5 that is formed by the electron beam 19 striking the incident surface 6, the X-ray tube has, among other things, the stationary electromagnets 29 and 30 that cause an electron beam 19 impinging the focal spot 18 to be formed. The electrons emitted from the cathode 2 are deflected to the focal spot 18 in the magnetic field generated by the electromagnets 29 and 30 whose field lines 21 are indicated with broken lines in FIG. 3. As shown, for example in the x/y plane, in FIG. 1 by a dot-dash lines that identify the path course of emitted electrons, the electrons moving with the velocity v radially onto the anode 5 experience a force F in the resultant magnetic field of the electromagnets 29 and 30 that deflects them the $\phi$ direction onto the focal spot 18. The deflection becomes weaker as the kinetic energy of the electrons increases. Since the exit velocity of the electrons from the cathode 2 is very low, and the electrostatic force acting between cathode 2 and anode 2 only accelerates them little by little, the electrons are deflected most at the start of their path motion in the proximity of the cathode 2. The force in the x/y plane focussing the electrons to an electron beam acts perpendicular to the rotational axis 1 proceeding in the z-direction and defines the width of the focal spot on the incident surface 6 of the anode 5.

The defocussing force thereby acting on the electrons in the z-direction is compensated by the electrostatic focussing of the rotational-symmetrical Wehnelt electrode 3 that defines the length of the focal spot 18 on the incident surface 6 of the anode 5. The focussing effect of the Wehnelt electrode 3 on the electrons that move from the cathode 2 to the anode 5 and form the electron beam 19 is indicated with dotdashed lines in FIG. 2.

The shape of the foal spot 18 is thus defined by the shape and strength of the magnetic field of the electromagnets 29 and 30 as well as by the strength of the electrostatic focussing by the Wehnelt electrode 3. A variable focal spot can be realized simply by a suitable combination of the Wehnelt voltage and the coil currents of the electromagnets 29 and 30.

The bearing of the vacuum housing 26 of the X-ray tube ensues via the shaft 33 with ball bearings 10 and 11 relative to a protective housing 31, indicated with broken lines in FIGS. 2 and 3. A particular advantage of the invention is that no bearing parts are located in the vacuum. This enables a wet lubrication of the ball bearings 10 and 11 during operation, allowing the bearing wear and the running noises to be drastically reduced. Moreover, the bearings are implemented free of play, then this leads to an improved stability of the focal spot with the possibility of clearly higher speeds of the X-ray tube compared to X-ray tubes of a conventional type. If the ball bearings are also replaceable, this leads to another enhancement of the economic feasibility of the X-ray tube.

As shown in FIGS. 2 and 3, an electric motor is present at the free end of the shaft 33 of the rotating X-ray tube, this motor having a rotor 17 torsionally connected to the shaft 33 and a stator 16. The shaft 33, and thus the vacuum housing 26 of the X-ray tube rigidly connected thereto, are placed in rotation around the rotational axis 1 with the electric motor. The drive for the vacuum housing 26 of the X-ray tube need not necessarily act on the shaft 33. It is also conceivable for the torque of the motor to attack directly at the anode. The drive, moreover, can also ensue with a pneumatic drive.

Figure 4:
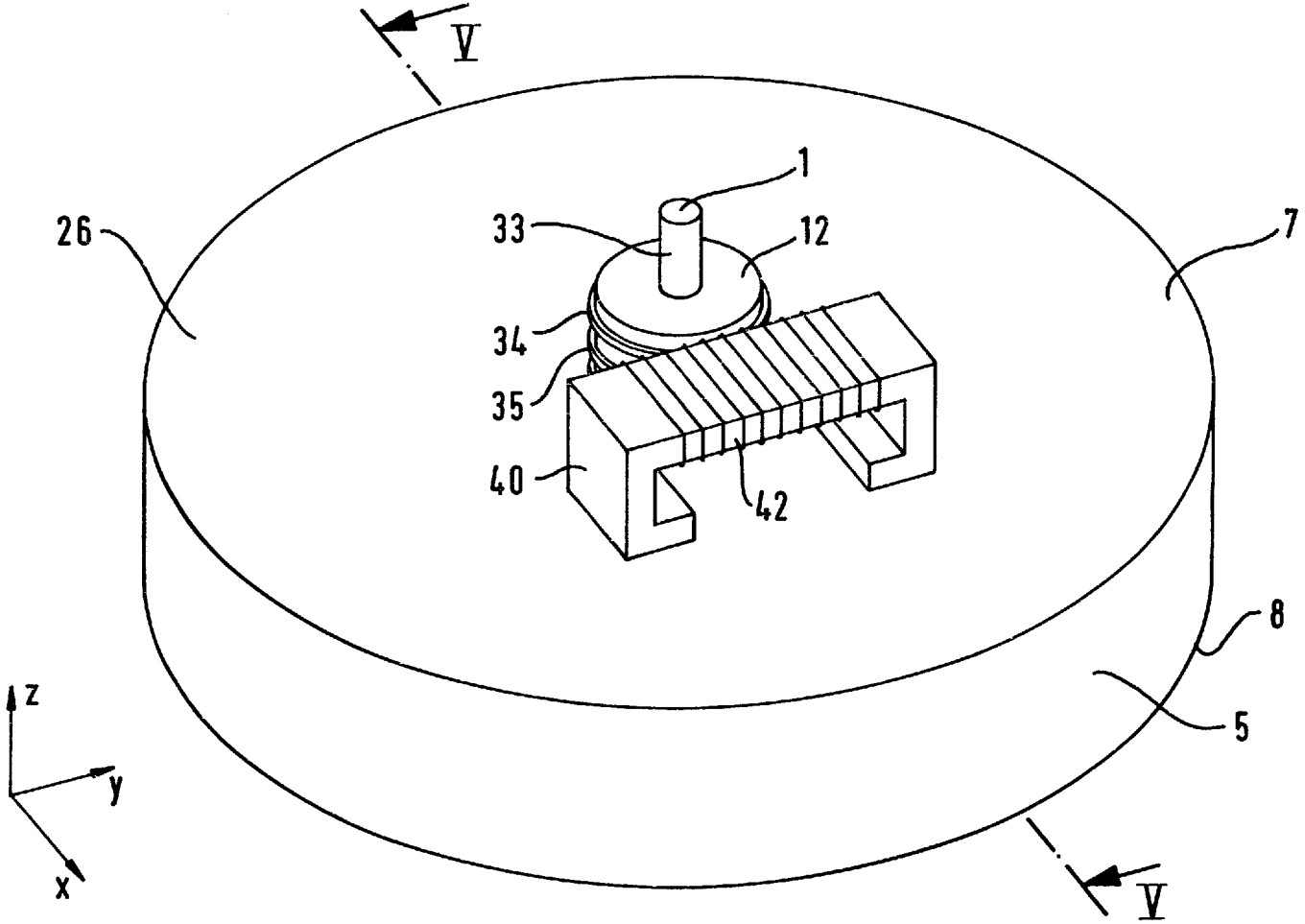
FIG. 4 a three-dimensional view of another embodiment of an inventive rotating X-ray tube.
Figure 5:
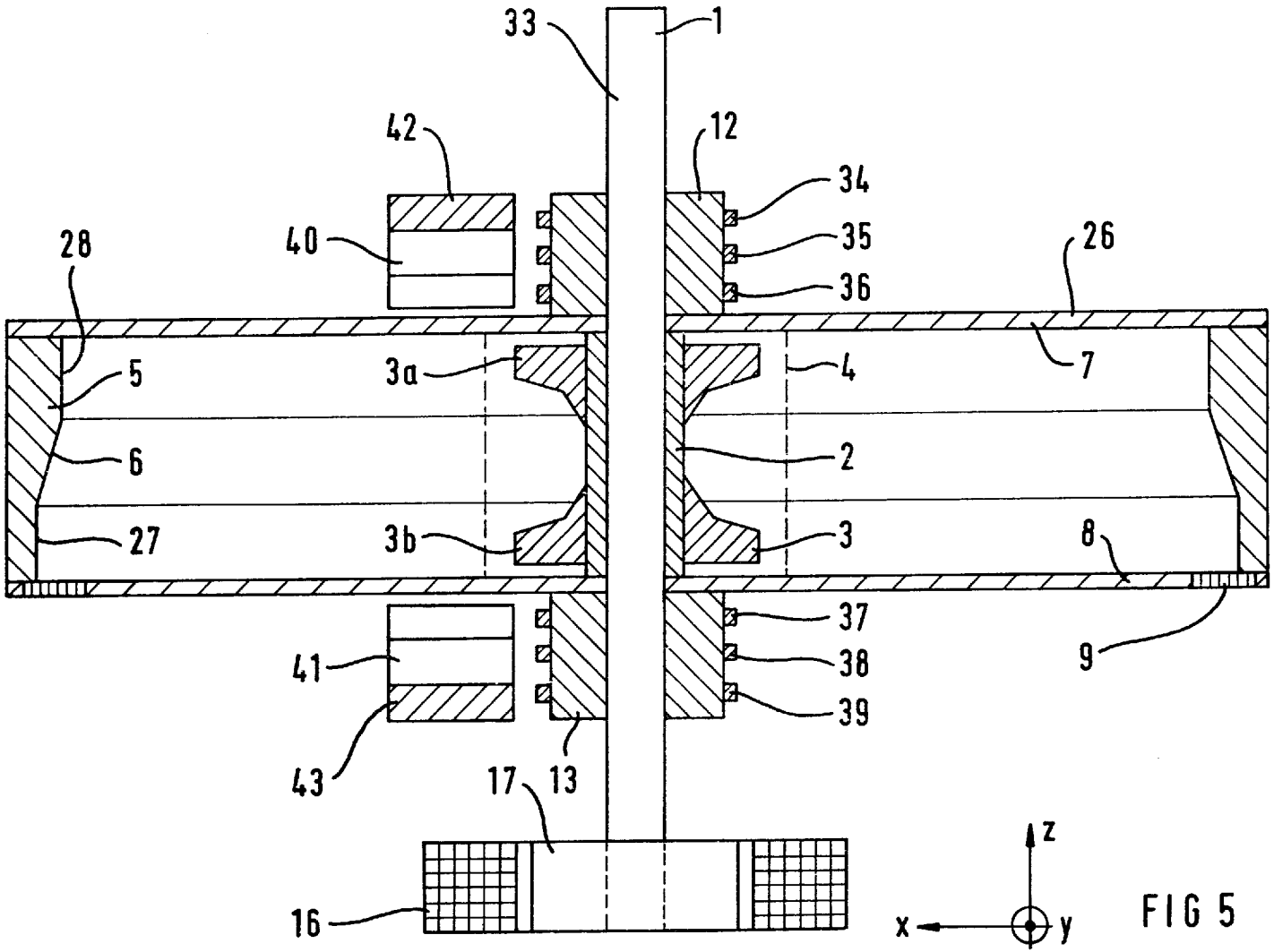
FIG. 5 is a section along the line V—V in FIG. 4.

Another exemplary embodiment of an inventive rotating X-ray tube is shown in FIGS. 4 and 5. In terms of structure and function, the rotating X-ray tube thereby essentially corresponds to the above-described exemplary embodiment. Differing from the above-described embodiment of the invention, however, two electromagnets 40 and 41 are provided as stationary means for magnetic focussing of the electron beam proceeding from the cathode 2 to the anode 5. Each electromagnet 40 and 41 has a U-shaped magnet core with a gap that is fashioned flange-like at the ends and rectangular excitation coils 42 and 43 that embrace the part of the magnet core lying opposite the gap. As may be seen from FIG. 5, the electromagnet 40 is attached in the proximity of the cover 7 and the high-voltage insulator 12 and the electromagnet 41 is attached in the proximity of the base 8 and the high-voltage insulator 13, respectively with the flange-like ends and the gap plane-parallel to the cover 7 or base 8 of the vacuum housing 26. The electromagnets 40 and 41 are aligned in the y-direction of the coordinate system entered in FIGS. 4 and 5 relative to one another so that their gaps lie opposite one another. The mounts of the electromagnets 40 and 41, moreover, are not shown in FIGS. 4 and 5. The electromagnets 40 and 41, which are at rest relative to the vacuum housing 26, thereby generate a magnetic field that is likewise at rest that focusses the electron beam proceeding from the cathode 2 to the anode 5. The physical focussing of the electrons emitted from the cathode 2 to form an electron beam that strikes a stationary focal spot on the incident surface 6 of the anode 5 thereby essentially corresponds to that of the above-described exemplary embodiment.

A particular advantage of the inventive rotating X-ray tube is that the anode 5 can be actively cooled. A coolant 32, an insulating oil in the present case, can be accepted (in a way not shown) in the protective housing 31 indicated with broken lines in FIGS. 2 and 3 and can circulate through a cooling unit in a circulation path, so as to directly charge the outside wall of the vacuum housing of the X-ray tube and thereby provide good heat elimination, and thus good cooling of the vacuum housing 26 of the X-ray tube, particularly of the ring-shaped anode 5. High continuous powers of the rotating X-ray tubes are accordingly possible connected with a clear reduction of the cooling times of the anode 5. If the ball bearings 10 and 11 also lie inside the protective housing 32 [sic], the insulating oil 32 can also function as lubricant for the wet lubrication of the ball bearings 10, 11.

Further, the rotating X-ray tubes can be utilized in pulsed operation due to the use of the control electrode 4.

Alternatively, the outside wall of the vacuum housing 26, for example in the region of the anode 5, can be provided with paddles (not shown in FIGS. 1 through 5), so that, as disclosed in German Utility Model 87 13 042, the insulating oil that emerges from nozzles (not shown in FIGS. 1 through 5) acts on the paddles as a directed flow so that a torque turning the vacuum housing 26 of the X-ray tube around the rotational axis 1 arises. In this case, specific drive means for the rotating X-ray tubes can be eliminated.

The inventive rotating X-ray tubes can be constructed with an overall short structure, as a result of which it is possible to construct small X-radiators with high cooling capacity. High speeds can be achieved in conjunction with the play-free bearing of the vacuum housing 26 of the X-ray tubes, as a result of which, for example, the disturbing wobbling of the focal spot in a computer tomograph is noticeably reduced.

Moreover, the cathode 2 need not necessarily be fashioned tubular and rotational-symmetrical and completely surround the shaft 22 within the vacuum housing 26 of the X-ray tubes in z-direction but, for example, can have an annular shape and be limited to the middle region of the shaft 33.

Although modifications and changes may be suggested by those skilled in the art, it is the intention of the inventors to embody within the patent warranted hereon all changes and modifications as reasonably and properly come within the scope of their contribution to the art.

We claim as our invention:

1. An X-ray tube comprising:

a vacuum housing having a rotational axis;

a ring-shaped anode connected to said vacuum housing and having a center axis coinciding with said rotational axis;

an annular cathode disposed inside said vacuum housing and surrounding said rotational axis, said cathode emitting an electron beam containing electrons propagating radially outwardly from said cathode;

means for mounting said vacuum housing for rotation around said rotational axis;

drive means for rotating said vacuum housing and said cathode around said rotational axis; and means for focussing said electron beam from said cathode onto said anode for causing said electron beam to strike said anode in a stationary focal spot.

2. An X-ray tube as claimed in claim 1 wherein said means for focussing said electron beam comprise magnetic focussing means and electrostatic focussing means.

3. An X-ray tube as claimed in claim 2 wherein said magnetic focussing means comprise at least two magnets stationarily disposed relative to said vacuum housing.

4. An X-ray tube as claimed in claim 2 wherein said electrostatic focussing means comprise a Wehnelt electrode having two electrode sections respectively disposed at opposite sides of said cathode.

5. An X-ray tube as claimed in claim 1 further comprising a control electrode disposed stationarily inside said vacuum housing and having a center axis coinciding with said rotational axis.

6. An X-ray tube as claimed in claim 1 wherein said means for mounting said vacuum housing comprises rolling bearings.

7. An X-ray tube as claimed in claim 1 wherein said drive means comprises an electric motor.

8. An X-ray tube as claimed in claim 1 wherein said drive means comprises a pneumatic drive.

9. An X-ray tube as claimed in claim 1 further comprising means for charging said ring-shaped anode directly with a coolant.

10. An X-ray tube as claimed in claim 9 wherein said coolant comprises a liquid.

11. An X-ray tube as claimed in claim 10 wherein said coolant comprises insulating oil.

12. An X-ray tube as claimed in claim 9 wherein said means for charging said ring-shaped anode directly with a coolant comprises means for charging an exterior of said ring-shaped anode with said coolant as a directed flow, and said X-ray tube further comprising a plurality of paddles mounted on said exterior of said anode for producing a torque for rotating said vacuum housing around said rotational axis due to interaction with said directed flow of coolant, said means for charging and said paddles thereby comprising said drive means.

* * * * *